US005637989A

United States Patent [19]

Wood

[11] Patent Number: 5,637,989

[45] Date of Patent: Jun. 10, 1997

[54] ENERGY SAVINGS APPARATUS

[76] Inventor: Sylvester Wood, 504 W. Main St., Weatherly, Pa. 18255

[21] Appl. No.: 382,144

[22] Filed: Jan. 31, 1995

[51] Int. Cl.[6] ..... G05F 1/613

[52] U.S. Cl. ..... 323/223

[58] Field of Search ..... 323/222, 223, 323/215, 217; 363/34, 37; 307/2

[56] References Cited

U.S. PATENT DOCUMENTS 3,319,074 5/1967 Koch ..... 307/66

4,202,367 5/1980 Petruska et al. ..... 307/2

4,745,537 5/1988 Cheung ..... 363/37

5,010,468 4/1991 Nilssen ..... 363/37

5,319,300 6/1994 Wood ..... 323/207

5,455,491 10/1995 Hajagos et al. ..... 323/223

*Primary Examiner*—Matthew V. Nguyen

*Attorney, Agent, or Firm*—Sanford J. Piltch

[57] ABSTRACT

An electrical power energy savings circuit for use with 220 volt ac power delivery systems for reducing the power drain of the power delivery system during the "off phase" for each of the 110 volt legs of the ac power supply circuit, as measured across the load.

8 Claims, 1 Drawing Sheet

ENERGY SAVINGS APPARATUS

FIELD OF THE INVENTION

This invention relates to alternating current electric power delivery in general, and in particular, to savings which may be achieved with alternating current power delivery systems.

BACKGROUND OF THE INVENTION

Reducing the power loss in electric loads has been a focus of much development for some time. While early work focused on power transmission losses, more recent developments have also addressed power losses in 220 volt and 110 volt residential and commercial site load networks. Power efficiency meters connected between a utility metering device and a residential or commercial load have measured the power loss or efficiency of such a site load network.

It has been found that power loss can be reduced by altering the sinusoidal shape of the 60 cycle voltage supplied by a utility company. The object of such previous work was to reduce the transition time of the voltage from half peak value to half peak value. This was done with 110 volt or 220 volt power supplies connected between a utility metering device and an electric load.

An energy savings device, power supply having an internal dc battery, is disclosed in U.S. Pat. 3,319,074. The patent describes an external ac source which is rectified and applied to a load under control of a transistor. The dc battery compensates for fluctuations of the ac power source and is maintained in a fully charged condition. The problem with operation of the energy savings device is that, while the power supply is designed to maintain a constant voltage on the load, the power supply introduces additional power losses and does not cope with the varying demands of ac loads, insofar as efficient supply of energy is concerned.

U.S. Pat. 4,206,367 (Petruska, et al.) shows a 220 volt power supply having an internal dc battery and a charge/discharge circuit. The energy savings device operates to reduce the power drawn from the utility company supplied external ac source while servicing the residential load. The device is constructed to provide a continuous sinusoidal wave through opposite phase, coupled dc batteries but, due to the inherent delays in the batteries, can only achieve an approximated sinusoidal waveform which is not sufficient to power electric motors and power supplies of modern equipment used in residences and businesses.

Use of the power supply shown in U.S. Pat. 4,206,367, in cooperation with electrical loads, has resulted in the increased use of power consumption metering of the power supplied by public utilities to their customers. However, these power use meters presently are unable to accurately measure energy savings actually being attained.

One method of improving the actual, real time measurement of power consumption of the Petruska, et al. patent is the error compensating circuit described in U.S. Pat. No. 5,319,300 [Wood]. In the Wood patent, the error compensation or correction circuit includes a pair of capacitors straddling another capacitor or a rechargeable battery source and uses switching transistors to apply an instantaneous voltage level corresponding to the sinusoidal ac supply voltage by controlling the charging and discharging of the voltage storage elements (i.e. the capacitors and battery) which results in an applied reverse current flow to the power metering device furnished by the power company. The applied reverse current flow corrects the power consumption measurement of the metering devices attached across the electrical load.

A residential use or power consumption meter is connected directly to the utility power metering device and uses the 220 volt power supplied at that point to calculate and record (by magnetic rotating dial and hand pointers) the power consumption of the customer. Residential use, while sometimes at 220 volts; e.g. electric ranges and clothes dryers, is primarily delivered at 110 volts. This is accomplished by splitting the three-wire 220 volt supply line into two, two-wire 110 volt subcircuits in the residential distribution box; i.e., the circuit breaker box.

The energy savings device of the Petruska, et al. patent is a 220 volt device which is intended to be connected between the utility power metering device and the residential circuit breaker box. A power consumption meter is a 220 volt device which is intended to be connected between the utility power metering device and the energy savings device of the Petruska, et al. patent. Due to the fact that most (if not all) power consumption meters measure 220 volt current usage across the load to calculate residential power consumption at both 220 volts and 110 volts, an error in calculating the true power consumption can occur.

The ability of the energy savings device in the Petruska, et al. patent to react to changes in current demand was severely limited by the voltage storage devices (i.e. the batteries) which were a part of the error measurement and compensation circuit. The Wood patent makes significant strides forward in the elimination of voltage storage devices with very slow response times by substituting for these devices voltage storage elements with faster response times (i.e. the capacitors of the Wood circuit arrangement) which achieve a significant reduction in response time resulting in a more accurate error compensation for the instantaneous current draw. However, due to the continued use of the complex circuitry arrangement which included, for example, complimentary and opposing current flow compensation circuits, the instantaneous result was not the pure sinusoidal waveform which was desired.

An object of the present invention is to provide an electrical power energy savings circuit means for a 220 volt ac power delivery system having a substantially instantaneous response for delivering a nominal sinusoidal waveform.

A further object of the present invention is to incorporate such an improved energy savings circuit means into a residential power supply of the type shown in connection with the error compensation circuit of U.S. Pat. 5,319,300.

An additional object of the present invention is to provide a residential power supply with an electrical power energy savings circuit which reduces the 220 volts drawn from the utility company ac voltage supply during 110 volt load usage in a substantially instantaneous manner.

Other objects will appear hereinafter.

SUMMARY OF THE INVENTION

The improved energy savings circuit of the present invention is intended to be connected in each 110 volt leg of a 220 volt ac supply line. The energy savings circuit or power supply circuit means is to be implemented in combination with an ac source of voltage, an electrical power metering means, and an associated electrical load having a power supply circuit for feeding current to the load. The power supply circuit means of the present invention for conducting current from the ac source of voltage to the load in alternate half cycles of the sinusoidal voltage waveform comprises a first circuit means for conducting current in one direction through the load in a first half cycle and a second circuit means for conducting current through the load in the opposing direction in a second half cycle of the source waveform. Said first and second circuit means being responsive to the positive and negative cycling of the ac source so that the current is conducted in the first half cycle in an out-of-phase relation to the current conducted in the second half cycle such that a complete sinusoidal waveform is presented to the load.

The first circuit means of the power supply circuit means provides a positive half sine wave to the load during the first half cycle of the sinusoidal voltage waveform from the ac power source. A voltage storage device is intended to be charged during this first half cycle in order to provide a sufficient potential (voltage) for current flow during the second half cycle for providing the negative half of the full sinusoidal wave to the load. The power supply circuit means further comprises a switching control means comprising a first switch means responsive to the positive half of the sinusoidal waveform from the ac source for energizing the first circuit means and a second switch means responsive to the negative half of the sinusoidal voltage waveform from the ac source for energizing said second circuit means. The switching control means further comprises a first phase control transformer means coupling the ac source to the first switch means for switching said first switch means to its conducting condition during the positive half cycle of the sinusoidal waveform and a second phase control transformer means coupling the ac source to the second switch means for switching said second switch means for switching said second switch means to its conducting condition during the negative half cycle of the sinusoidal waveform.

The power supply circuit means further comprises a voltage delay elimination means for controlling the switching of the second switch means by monitoring the current load demand to eliminate time delay in the current flow in the second circuit means for providing the negative half wave of the sinusoidal waveform to the load without the occurrence of a time delay.

It is also intended with the present invention to provide an error correction circuit means between the electrical power metering means and the improved power supply circuit means of the present invention. Since the present invention may be applied to each leg of a power supply circuit, it is also intended to combine paired error correction circuit means, one in each leg of the power supply circuit, for accomplishing the same end; a reduction of metered electrical power such that the electrical power metering means measures power usage in direct proportion to the actual electrical load.

BRIEF DESCRIPTION OF THE DRAWINGS

For the purpose of illustrating the invention, there is shown in the drawings forms which are presently preferred; it being understood, however, that the invention is not limited to the precise arrangements and instrumentalities shown.

DETAILED DESCRIPTION OF THE DRAWINGS

The following detailed description is of the best presently contemplated mode of carrying out the invention. The description is not intended in a limiting sense, and is made solely for the purpose of illustrating the general principles of the invention. The various features and advantages of the present invention may be more readily understood with reference to the following detailed description taken in conjunction with the accompanying drawings.

Figure 1:
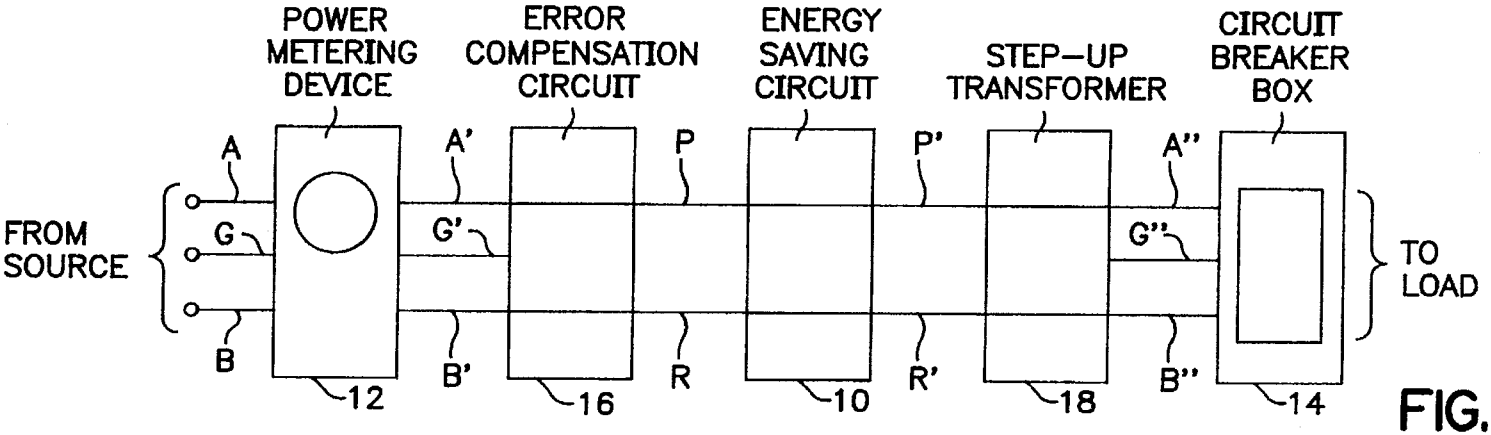
FIG. 1 is a representative block diagram of the electrical power delivery circuit to a residence or commercial establishment including the improved power supply circuit of the present invention.

Referring now to the drawings in detail, where like numerals refer to like parts or elements, there is shown in FIG. 1 the present invention of the improved energy savings circuit means, which is identified, generally, as 10. The energy savings circuit 10 is interposed between the utility power metering device 12 and the residential or commercial circuit breaker box (i.e. the load network) 14. The energy savings circuit 10 can follow an error compensation circuit means 16 (such as the the error compensation circuit of the Wood patent) and precede a step-up transformer means 18 which feeds the circuit breaker box 14 with the desired voltage. The circuit breaker box 14 connects to a variety of individual electrical loads situated within the residential or commercial site, the connections to which are not shown. Also, the power supply source which is connected to the power metering device 12 is indicated only by entry feed lines, A, B and G. The proposed connections and specific usages will be described in greater detail hereinafter.

Figure 2:
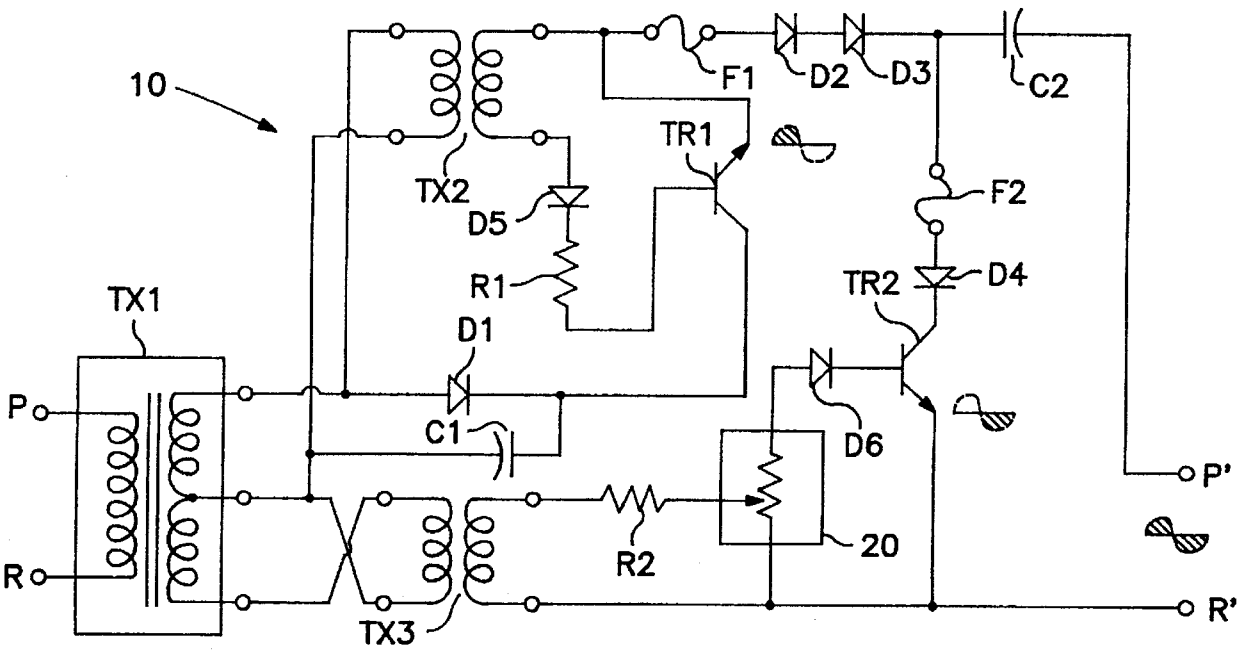
FIG. 2 is a schematic diagram of the improved power supply circuit of the present invention.

With reference to FIG. 2, the energy savings circuit 10 can be described as follows. The external power source from the utility company is delivered to most residential and commercial properties in a 3-wire system carrying 240 volts ac across the two feed lines A, B, with the third line G being neutral. Such wire delivery system usually comes from a step-down transformer connected to the utility company power distribution net. At the entrance to the property receiving the power delivery the utility company terminates its lines in a power metering device such as the meter box 12 of FIG. 1. Exiting the meter box 12 on the private property side of the box is a 3-wire system delivering 240 volts ac as measured between two of its legs A', B' with the third leg G' being ground.

An error compensation circuit 16 of the type described in the Wood patent may be placed following the power metering device 12 to appropriately monitor actual power usage and reflect the unnecessary current so that the power metering device registers only the actual power consumed. The functioning of such error compensation circuit is more fully set forth in the Wood patent, which description is incorporated by reference as if fully set forth herein. If used, the error compensation circuit produces a 60 Hz 110 ac sinusoidal voltage across the output terminals P, R and that voltage is applied to the input terminals of the energy savings circuit 10 of the present invention.

If an error compensation circuit is not utilized, then the input terminals of the energy savings circuit 10 can be connected to either leg, A' or B', and the neutral leg G coming from the power metering device 12 to apply the desired 110 volts ac. In either case, the energy savings circuit 10 is to be connected across the incoming power supply of the residential/commercial power delivery system entering the property. The reader is to understand that the energy savings circuit 10, which is shown in FIG. 2, when connected across legs A' and G' of the power delivery system will permit a substantially identical energy savings circuit (not shown) to be connected across legs B' and G' of the same power delivery system, the result of which will be described more fully below.

In further description of the energy savings circuit means 10 of the present invention, a first transformer means TX-1 is employed across input lines P and R to apply 110 volts ac directly to circuit elements of the energy savings circuit 10. A second transformer means TX-2 is employed to provide 12.6 volts ac to certain circuit elements with the second transformer means TX-2 deriving its voltage directly from the secondary of the first transformer means TX-1. A third transformer means TX3 is employed to provide 12.6 volts ac to another group of circuit elements with the third transformer means TX3 also deriving its voltage from the secondary of the first transformer means TX1, but 180° out of phase from the second transformer means TX2.

The circuit elements of the energy savings circuit 10 are all indicated by standard symbols. One group of circuit elements are used during a first half-phase cycle to provide the current conducted through said power source during a first half-phase of each cycle of the alternating current source to charge a dc power source and provide the conducted current to the load. During the other half-phase cycle, the alternating current flows through the load by discharge of the dc power source (i.e. a designated capacitor) through a second group of circuit elements which are switched to a conducting state by an appropriate phased signal voltage from one of the transformer means connected to the alternating current source.

The specific functioning of the groups of circuit elements is as follows. During the first half-phase of a single cycle of the alternating current which, for purposes of this example will be described as a positive portion of the sinusoidal waveform of the alternating current, the secondary coil or winding of the first transformer means TX1 provides 110 volts ac to diode D1 which causes capacitor C1 to charge to approximately 157 volts dc. Diode D1, like all of the diodes described in connection with the energy savings circuit means 10, is rated at 600 volts, 1 amp. The capacitor C1, as well as the capacitor C2 to be described later, is rated at 300 volts dc, 260 μf.

During the positive half cycle current will flow through transistor TR1, which has been switched on by 12.6 volts ac being provided through step down transformer TX2 through diode D5 and resistor R1, where R1 has an impedance of 150 ohms and is rated for 1 watt. The current flows through fuse F1 and through diodes D2 and D3 and (once charged to its capacity) through capacitor C2 to the load. Thus, a current is provided across the terminals P', R' ($i_{pos}$) during the positive half sinusoidal wave of the alternating current delivered from the power distribution network of the utility company.

During the negative half cycle transistor TR1 is turned off and transistor TR2 is turned on as transformer means TX2 is rendered non-conductive during the positive half cycle and transformer means TX3 conducting during the negative half cycle of the alternating current delivered from the power source. With transformer means TX3 conducting, current flows through resister R2 to a voltage delay elimination means 20 and then through diode D6 to turn on transistor TR2. When transistor TR2 is turned on, current is permitted to flow in a reverse direction ($i_{neg}$) from the discharging of capacitor C2 and through the load. The current ($i_{neg}$), being blocked by diodes D2 and D3, flows through diode D4 and the switched on transistor TR2 providing a negative half sinusoidal wave of the alternating current to the terminals P', R'. The current ($i_{pos}$) is not utilized during the second half cycle.

The result of one cycle of operation of the energy savings circuit means 10 is to provide one complete sinusoidal waveform at terminals P', R' (across the load) using the charged dc voltage storage device (capacitor C2) and only one-half of the waveform emanating from the power source. In this manner a voltage of 110 volts ac can be provided across the output terminals P', R' and applied through the step-up transformer 18 to the "load" in the circuit breaker box 14.

A similarly functioning energy savings circuit 10 to that connected to the "A side" of the power delivery system can be connected to the "B side" of the power delivery system in the same manner and with the same results. The "B side" energy savings circuit means will be identical to the "A side" and will function in exactly the same manner, excepting that the sinusoidal waveform resulting from the energy savings circuit means on the "B side" will be produced with the negative half wave first and the positive half wave second so that the voltages produced at the output terminals of each energy savings circuit means will be 180° out of phase.

The transformer means TX-1 may have its primary winding connected across the P and R output terminals of an error compensation means (such as described in the Wood Patent) or across the A' and G' legs of the power source so that a nominal 110 volt ac voltage is applied across the input terminals of its primary winding. The transformer means TX-1 is configured such that its dual secondary windings have a center tap so that 110 volts ac can be tapped between either end of the secondary coil and the center tap. The connections shown in FIG. 2 to each of the transformer means TX2 and TX3 are that such first and second transformer means TX2 and TX3 conduct 180° out of phase with each other, thus providing the switching of the current flow in the energy savings circuit 10 through the use of the transistors TR1 and TR2.

The voltage supplied by the power company and applied across the input legs A and B typically varies sinusoidally for each cycle of the alternating current. The alternating current may be conducted through diode D1 and diode/transistor circuit containing diodes D2 and D3 and transistor TR1 during the positive half of the complete alternating cycle of the current emanating from the power source resulting in the charging of capacitors C1 and C2. The alternating current, however, is blocked by the diodes D2 and D3 during the negative half cycle and by the diode D4 and transistor TR2 during the positive half cycle (as the circuit is drawn in FIG. 2) so that current flows in the appropriate direction to create the complete sinusoidal wave at the output terminals P', R' and across the load.

The capacitors C1 and C2, when each of them conduct the alternating current to the load, are charged so that each capacitor will maintain a fully charged condition despite the current drain which occurs each cycle during the non-conductive periods of the transistor switched circuits through the previously noted blocking diodes. Therefore, the capacitors act as a current collecting or storage device which may either pass the current in a reverse current flow mode or store voltage for assistance in forward current flow through the energy savings circuit means 10. The transistors TR1 and TR2 act merely as switchable control means for the period when each of the capacitors C1 and C2 will conduct current during pre-determined half cycles of the alternating current from the power source.

Transformer means TX3 receives 110 volts ac to its primary winding and produces 12.6 volts ac to its secondary winding, applying that voltage through resistor R2 to the voltage delay elimination means 20, which is depicted in FIG. 2 as a variable resistor, adjustable for the purpose of setting the voltage trigger point for transistor TR2 to switch on and to conduct current during the half cycle period of the alternating current from the power source in which it is energized. The purpose of the voltage delay elimination means 20 is to provide a current demand following device which constantly monitors the load so that the half wave produced from the dc voltage storage device is triggered at the appropriate instant in time. Otherwise, an offset or delay could occur in the sinusoidal waveform applied to the load which would be damaging to ac motors and other similar devices.

The variable resistor in the box designated 20 is a simplistic view of the feedback correction circuit for following current demand and compensating for any change in the load to the energy savings circuit 10 to eliminate delay in triggering transistor means TR2. Such circuit means for monitoring current demand and instantly providing a signal indicative of the instantaneous load current demand, such that compensation for the demand can be instantaneously achieved, are known in the field and further discussion is not deemed warranted. It is sufficient to state that the automatic feedback circuit for monitoring current demand of the load is utilized to trigger the energization of transistor TR2 so no delay is occasioned by the energy savings circuit 10. The simple variable resistor, with its voltage adjustment, is intended to show this principle without resort to a more complex circuit arrangement.

Of course, the "B" side energy savings circuit means 10 will function in the same manner, but provide at its output a similar voltage which is 180° out of phase with the "A" side output. It is not deemed necessary to provide a complete description of the elements of a second energy savings circuit, as each element will be positioned in the same location in the circuit and serve the identical function.

The use of the energy savings circuit means 10 of the present invention greatly reduces the power drain during the "off phase" for each of the 110 volt legs of the ac power supply circuit, as measured across the load. It is to be observed that the currently described energy savings circuit means 10 provides its energy output (a full wave sinusoidal waveform at 60Hz and 110 volts ac) without the need for independent power sources or batteries which act as current collection or storage devices and, instead, has significantly reduced the necessary elements and control circuit elements such that a consistent symmetrical sinusoidal waveform is produced at the load connection points of the energy savings circuit means 10.

The circuit arrangement of the present invention also significantly reduces, if not entirely eliminates, any time delay in switching from the positive half wave to the negative half wave at the load connection point P', R' of the energy savings circuit means 10. This significant reduction in the delay time, which provides a smooth, fully symmetrical sinusoidal waveform is achieved by placing the capacitors C1 and C2 into the circuit in mutually exclusive "on" or "charging" conditions such that any charge remaining in capacitor C1 after the positive half cycle circuit elements of the energy savings circuit means are turned off by turning off transistor TR1 and the circuit elements of the second half of the circuit means are turned on by transistor TR2, will be cancelled by the charge in capacitor C2. Hence, the result will be no time delay between the positive half and the negative half of the resulting sinusoidal waveform across the load.

Therefore, use of the electrical power consumption energy savings circuit means of the present invention will yield energy savings and, when used with an error compensation circuit, a more accurate residential/commercial power consumption measurement by a 220 volt electrical power consumption meter.

The present invention may be embodied in other specific forms without departing from the spirit or essential attributes thereof and, accordingly, the described embodiments are to be considered in all respects as being illustrative and not restrictive, with the scope of the invention being indicated by the appended claims, rather than the foregoing detailed description, as indicating the scope of the invention as well as all modifications which may fall within a range of equivalency which are also intended to be embraced therein.

I claim:

1. In combination with a 110 volt ac voltage source, an electrical power metering means, and an associated electrical load having power supply circuit for feeding current to said load, a power supply circuit means for conducting current from the ac voltage source to said load in alternate half cycles, the improvement comprising: first circuit means for conducting current in one direction through the load in a first half cycle and second circuit means for conducting current through the load in the opposing direction in a second half cycle, said first and second circuit means being responsive to the positive and negative cycling of the ac voltage source so that current is conducted in the first half cycle in an out-of-phase relation to the current conducted in the second half cycle, a switching control means having a first switch means responsive to the positive half of the sinusoidal voltage waveform from the ac voltage source for energizing said first circuit means and a second switch means responsive to the negative half of the sinusoidal voltage waveform from the ac voltage source for energizing said second circuit means, and a voltage delay elimination means for controlling the switching of the second switch means by monitoring the current load demand to eliminate time delay in the current flow in the second circuit means for providing the negative half wave of the sinusoidal waveform to the load without the occurrence of a time delay such that a complete sinusoidal waveform is instantaneously presented to the load.

2. The apparatus of claim 1, wherein the first circuit means provides a positive half sine wave to the load during the first half cycle.

3. The apparatus of claim 1, wherein a voltage storage device is charged during the first half cycle so as to provide sufficient potential for current flow during the second half cycle for providing the negative half of the full sinusoidal wave to the load.

4. The apparatus of claim 1, wherein said switching control means further comprises a first phase control transformer means coupling the ac voltage source to the first switch means for switching said first switch means to its conducting condition during the positive half cycle of the sinusoidal waveform and a second phase control transformer means coupling the ac source to the second switch means for switching said second switch means to its conducting condition during the negative half cycle of the sinusoidal waveform.

5. In combination with a 100 volt ac voltage source, an electrical power metering means, an error compensating circuit means for accurate measurement of actual power consumption and an associated electrical load having power supply circuit for feeding current to said load, a power supply circuit means for conducting current from the ac voltage source to said load in alternate half cycles, the improvement comprising: first circuit means for conducting current in one direction through the load in a first half cycle and second circuit means for conducting current through the load in the opposing direction in a second half cycle, said first and second circuit means being responsive to the positive and negative cycling of the ac voltage source so that current is conducted in the first half cycle in an out-of-phase relation to the current conducted in the second half cycle, a switching control means having a first switch means responsive to the positive half of the sinusoidal voltage waveform from the ac voltage source for energizing said first circuit means and a second switch means responsive to the negative half of the sinusoidal voltage waveform from the ac voltage source for energizing said second circuit means, and a voltage delay elimination means for controlling the switching of the second switch means by monitoring the current load demand to eliminate time delay in the current flow in the second circuit means for providing the negative half wave of the sinusoidal waveform to the load without the occurrence of a time delay such that a complete sinusoidal waveform is instantaneously presented to the load.

6. The apparatus of claim 5, wherein the first circuit means provides a positive half sine wave to the load during the first half cycle.

7. The apparatus of claim 5, wherein a voltage storage device is charged during the first half cycle so as to provide sufficient potential for current flow during the second half cycle for providing the negative half of the full sinusoidal wave to the load.

8. The apparatus of claim 5, wherein said switching control means further comprises a first phase control transformer means coupling the ac voltage source to the first switch means for switching said first switch means to its conducting condition during the positive half cycle of the sinusoidal waveform and a second phase control transformer means coupling the ac source to the second switch means for switching said second switch means to its conducting condition during the negative half cycle of the sinusoidal waveform.

* * * * *